US010029849B1

(12) United States Patent
Genotti, III

(10) Patent No.: US 10,029,849 B1
(45) Date of Patent: Jul. 24, 2018

(54) GARBAGE CAN ATTACHMENT

(71) Applicant: Adrian John Genotti, III, Jacksonville, FL (US)

(72) Inventor: Adrian John Genotti, III, Jacksonville, FL (US)

( * ) Notice: Subject to any disclaimer, the term of this patent is extended or adjusted under 35 U.S.C. 154(b) by 9 days.

(21) Appl. No.: 15/415,272

(22) Filed: Jan. 25, 2017

(51) Int. Cl.
*B65F 1/10* (2006.01)
*B65F 1/14* (2006.01)
*B65B 67/04* (2006.01)

(52) U.S. Cl.
CPC ..... *B65F 1/10* (2013.01); *B65B 67/04* (2013.01); *B65F 1/141* (2013.01); *B65F 2240/138* (2013.01)

(58) Field of Classification Search
CPC ..... B65F 1/04; B65F 1/08; B65F 1/10; B65F 1/14; B65F 2240/138; B65B 67/04
See application file for complete search history.

(56) References Cited

U.S. PATENT DOCUMENTS 1,167,782 A * 1/1916 Richards ..... B65B 67/04 141/108
4,193,157 A * 3/1980 Large ..... B65B 67/1238 15/257.1
4,312,531 A * 1/1982 Cross ..... E01H 1/12 141/108
4,470,627 A * 9/1984 Carroll ..... B65B 67/1238 141/108
4,749,011 A * 6/1988 Rylander ..... B65B 67/1238 141/114
4,802,258 A * 2/1989 Jensen ..... A47L 13/52 141/108
D308,270 S * 5/1990 Sarabia ..... D30/162
5,107,666 A * 4/1992 Rahtican ..... B65B 67/1238 141/316
5,213,141 A * 5/1993 Dorman ..... B65F 1/0006 141/10
5,498,046 A * 3/1996 Ridley, Sr. ..... A01D 51/00 15/257.1
5,655,739 A * 8/1997 Teh-Wah Goo .... B65B 67/1233 141/390
5,785,369 A * 7/1998 Ridley, Sr. ..... A01D 51/00 15/257.1
5,915,768 A * 6/1999 Young ..... B65B 67/12 15/257.1
6,155,522 A * 12/2000 Anderson ..... B65B 67/12 248/101
6,708,742 B2 * 3/2004 Weathers ..... B65B 67/04 141/391
6,938,860 B2 * 9/2005 Singleton ..... B65F 1/00 141/390
6,974,167 B2 * 12/2005 Springs, II ..... B65F 1/10 15/257.1

(Continued)

*Primary Examiner* — Nicolas A Arnett
(74) *Attorney, Agent, or Firm* — Lawrence J. Gibney; Mitchell Ghaneie

(57) ABSTRACT

The collection of yard debris and/or trash is accomplished through the use of an attachable scoop that is affixed to a garbage can. The scoop is attached to the trash can by the user and the assembly is laid flat against the ground. The yard debris is collected by pushing the debris along the scoop surface and into the garbage can. A handle is provided that allows the user to easily lift the assembly to its upright position. The scoop can be removed from the trash can and stowed after the job has been completed.

6 Claims, 7 Drawing Sheets

(56) References Cited

U.S. PATENT DOCUMENTS 6,983,965 B1 * 1/2006 Bergell ..... B65B 67/1238 141/390
7,131,552 B2 * 11/2006 Simonson ..... B65F 1/06 220/495.06
7,219,705 B2 * 5/2007 Wallek ..... B65F 1/06 141/337
7,302,978 B1 * 12/2007 Kolarik ..... B65B 67/1205 141/391
7,744,044 B2 * 6/2010 Gabriel ..... B65B 67/12 248/101
7,752,706 B2 * 7/2010 Goodger ..... A47L 7/00 15/327.4
7,815,153 B2 * 10/2010 Campbell ..... B65B 67/04 248/95
7,984,733 B2 * 7/2011 Noonan ..... B65F 1/00 141/337
8,291,543 B2 * 10/2012 McCoy ..... A47J 47/18 15/257.1
8,757,563 B2 * 6/2014 Muse ..... B65B 39/007 248/97
8,959,704 B1 * 2/2015 Pena ..... B65F 1/10 15/257.1
D769,563 S * 10/2016 Garcia ..... D32/74
9,480,383 B2 * 11/2016 Wollman ..... A47L 13/52
9,718,571 B1 * 8/2017 Busboom ..... B65B 67/04
D802,865 S * 11/2017 Dervin ..... D34/10
9,862,541 B2 * 1/2018 Fritch ..... B65F 1/10
2003/0173471 A1 * 9/2003 Weathers ..... B65B 67/04 248/99
2011/0041954 A1 * 2/2011 Noonan ..... B65F 1/00 141/316
2011/0260013 A1 * 10/2011 Richardson ..... B65B 67/04 248/99
2011/0277883 A1 * 11/2011 Noonan ..... B65B 67/04 141/337
2011/0283474 A1 * 11/2011 McCoy ..... A47J 47/18 15/257.1
2012/0012228 A1 * 1/2012 Karabas ..... B65B 67/04 141/114
2012/0248118 A1 * 10/2012 Perkowski ..... B65B 67/1205 220/495.08
2015/0274416 A1 * 10/2015 Garcia ..... B65F 1/02 220/200

* cited by examiner

GARBAGE CAN ATTACHMENT

BACKGROUND OF THE INVENTION

A. Field of the Invention

This invention relates to attaching an apparatus to a lip of a trashcan for collecting leaves and other loose debris or residue.

B. Prior Art

While there are numerous garbage can attachments, the present invention is a unique and novel trashcan attachment. Campbell U.S. Pat. No. 7,815,153 ('153) teaches a device that is specifically designed to be used with a leaf blower. The entry structure is of a fanned shape and is intended to be attached to a garbage bag. In addition, the '153 patent does not provide a handle or other means to pull the bag up.

Another representative example in the prior art is Goodger U.S. Pat. No. 7,752,706 ('706). In this patent it is taught that a person can place a trash can on wheels, but does not anticipate the use of a fan shaped structure to lay the can flat on the ground. Also, this invention taught in '706 does provide a handle to pull the wheeled cart.

Another prior art reference is Bergell U.S. Pat. No. 6,983,965 ('965). Although the invention disclosed in '965 incorporates the use of a rectangular trashcan, it lacks several improvements provided by the present invention, such as but not limited to, the '965 patent is not integral and securely attached to the trash can, does not provide an inlet ridge to prevent debris from falling back outside the trashcan and there is no handle to pull the trashcan up with. The entry point is also structured differently than the present invention, so as to be less efficient and versatile for collection.

A final representative example is Weathers U.S. Pat. No. 6,708,742 ('742), which is utilized with a garbage bag and does not allow a user to reposition the bag without having to bend over. The act of bending over can be difficult for some users and is not required with the present invention.

BRIEF SUMMARY OF THE INVENTION

The present invention is an attachment for a garbage can that involves placing the attachment on the garbage can's top portion. Once the attachment is clipped on to the garbage can's top rim, the attachment and can then lay in a flat position along the ground. In order to prevent leaves or other debris from sliding outside of the garbage can, the attachment provides a fold down edge at the beginning of the scoop as well as a camber or raised portion that will prevent the leaves or other debris from escaping from the can. Holes proximate to the fold down edge are also provided to secure the device in the ground, if desired.

The scoop would have a bottom panel and two side panels to effectively gather a large amount of yard debris or trash. Additionally a raised portion of the bottom panel of the scoop will insure that the contents of the yard debris or trash that has been collected will be funneled into the garbage can and not fall out.

In addition, a handle would be provided to allow a user to tilt the attachment and garbage can from a lowered position to an upright position and vice versa. It is further anticipated that a tilting mechanism may be provided to assist in smoothly transitioning between upright and lower positions.

Although no specific material is being claimed, the choice of material should reflect that the device will be exposed to a variety of environmental conditions including possible damage from rakes and shovels as well as extremes in temperature or inclement weather. Plastic is a likely a first choice of material but other materials may also be considered.

NUMBERING REFERENCE

Figure 1:
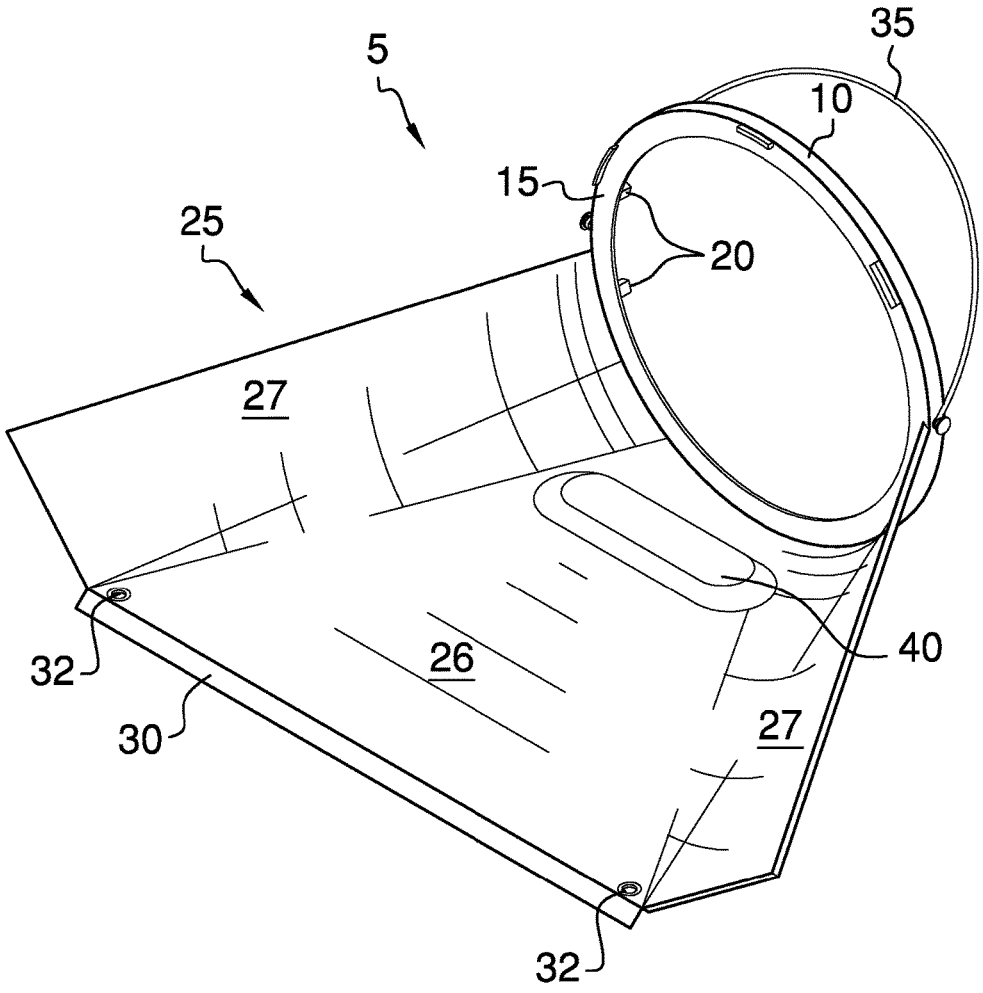
FIG. 1 is a front isometric view of the present invention.

1—Garbage Can
5—Device
10—Rim
15—Flange
20—Clips
25—Scoop
26—Bottom Panel
27—Side Panel
30—Edge
32—Holes
34—Spikes
35—Handle
40—Camber

DETAILED DESCRIPTION OF THE EMBODIMENTS

The present invention is an attachment for a receptacle such as a garbage can or other object that may hold leaves or other material such as debris or trash. The attachment is comprised of a single piece of material that is comprised of a rim 10, a flange 15, a plurality of clips 20, a scoop 25 that is formed by a bottom panel 26 and two side panels 27, and a fold down edge 30 along the front edge of the bottom panel 26. Holes 32 are provided proximate to the fold down edge if the user wanted to secure the device to the ground using a pair of stakes 34. The fold down edge 30 is angled towards the ground surface.

Figure 6:
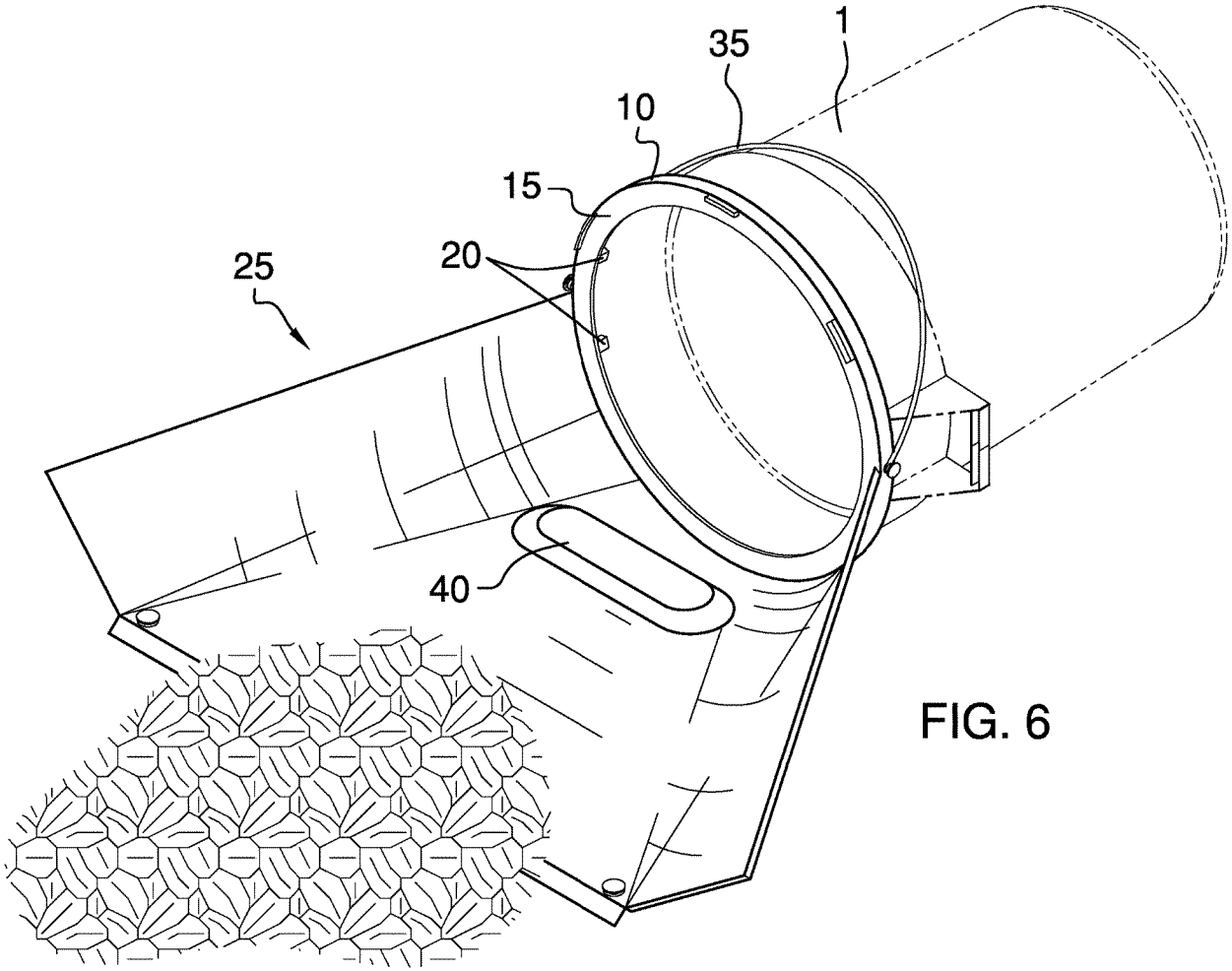
FIG. 6 is a front isometric in use view of the present invention.
Figure 7:
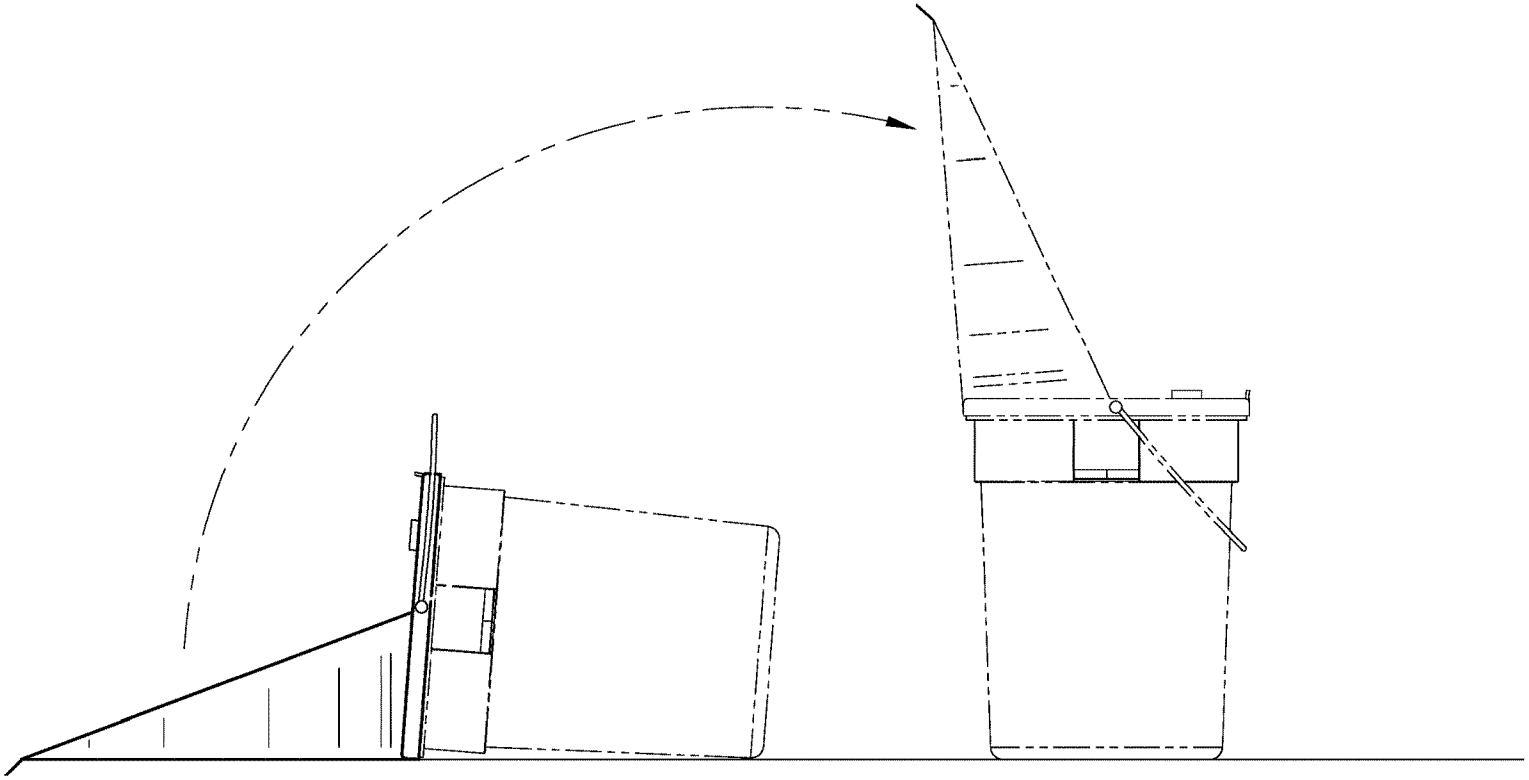
FIG. 7 is an in-use view of the present invention, which is showing that the device as it is attached to the garbage can be lifted from a laying position to an upright position with the handle of said device.

The bottom panel 26 and side panels 27 will form the mouth of the attachment and direct the trash/debris into the garbage can as depicted in FIG. 6. The device 5 will also have at least one handle 35. The attachment is portable and can be relocated from one garbage can to another as the user desires using a plurality of clips 20 that will allow the user to transfer the device from one garbage can to another can, if desired.

Figure 4:
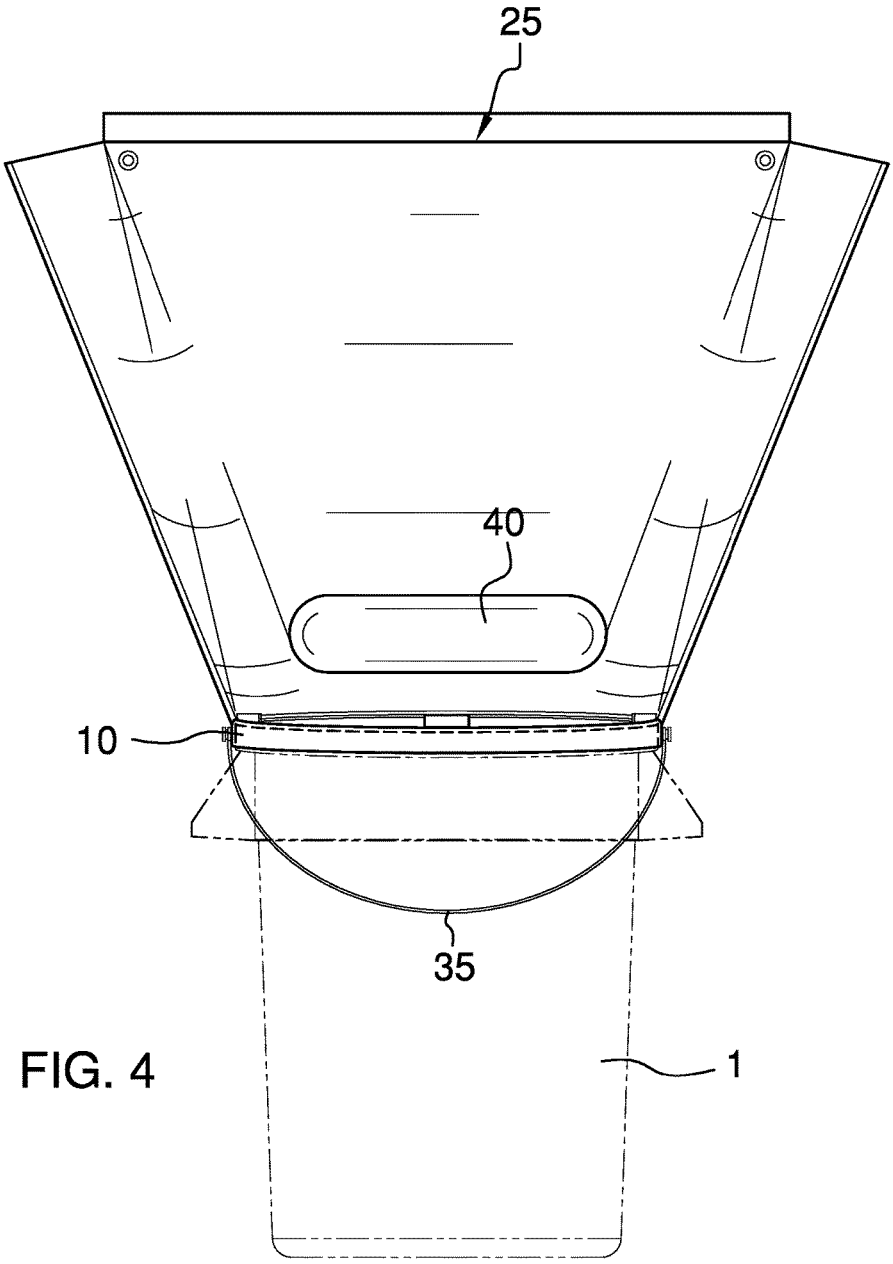
FIG. 4 is a top view of the present invention.
Figure 5:
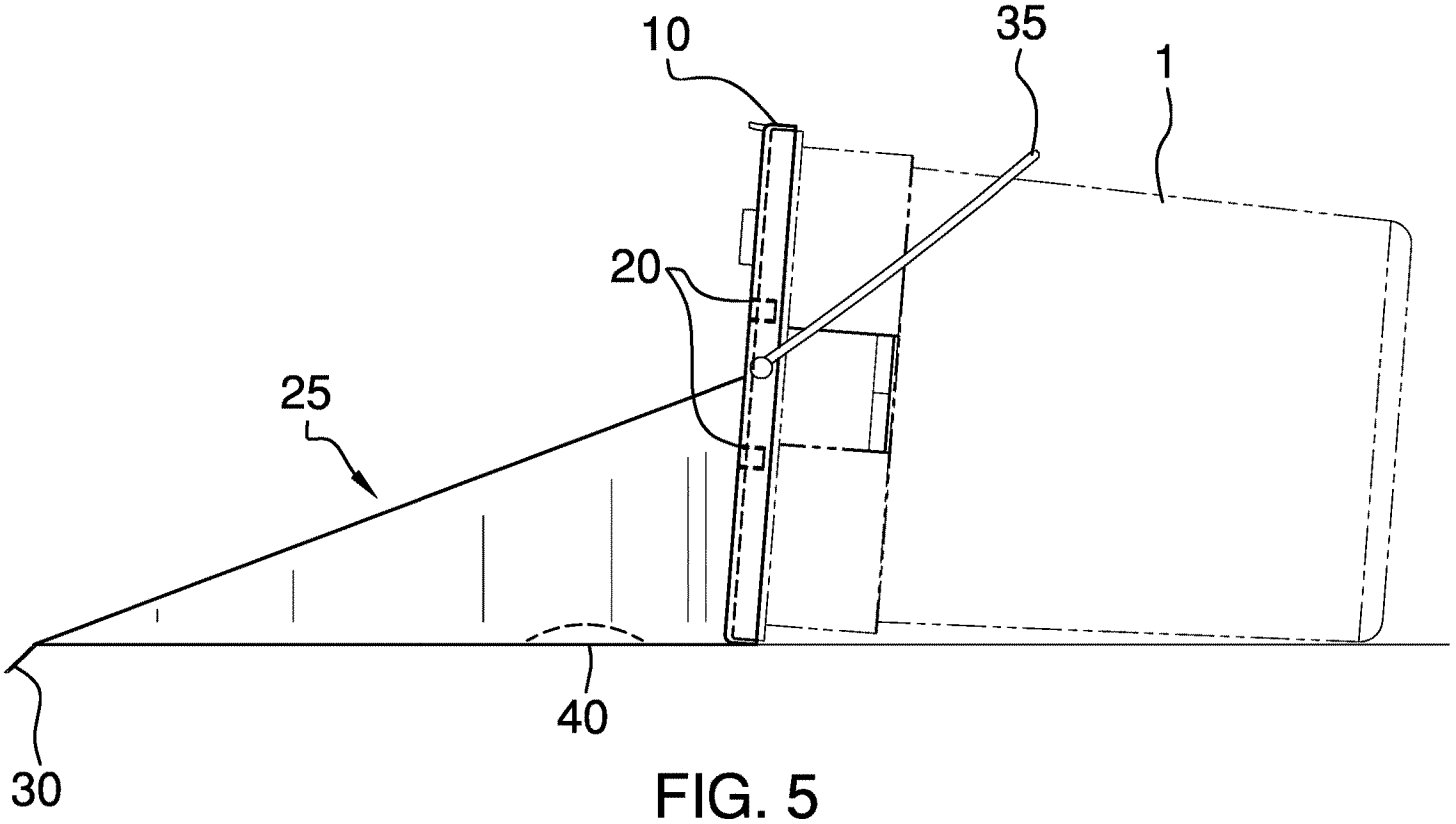
FIG. 5 is a side view of the present invention.

The rim 10 is shown to be made of a semi-rigid or rigid material and fits over the lip of a garbage can with a circular opening as shown in FIG. 4 and FIG. 5. However, it is anticipated that while the present invention shows a garbage can with a circular opening, the rim of the attachment can be modified to fit with other shaped garbage can openings as well. For example, some garbage cans have a square with rounded corners opening and other garbage cans have a semicircular opening. It is further anticipated that the rim can be made of a flexible material or adjustable design to then fit universally around a large variety of differently shaped garbage can openings.

Figure 2:
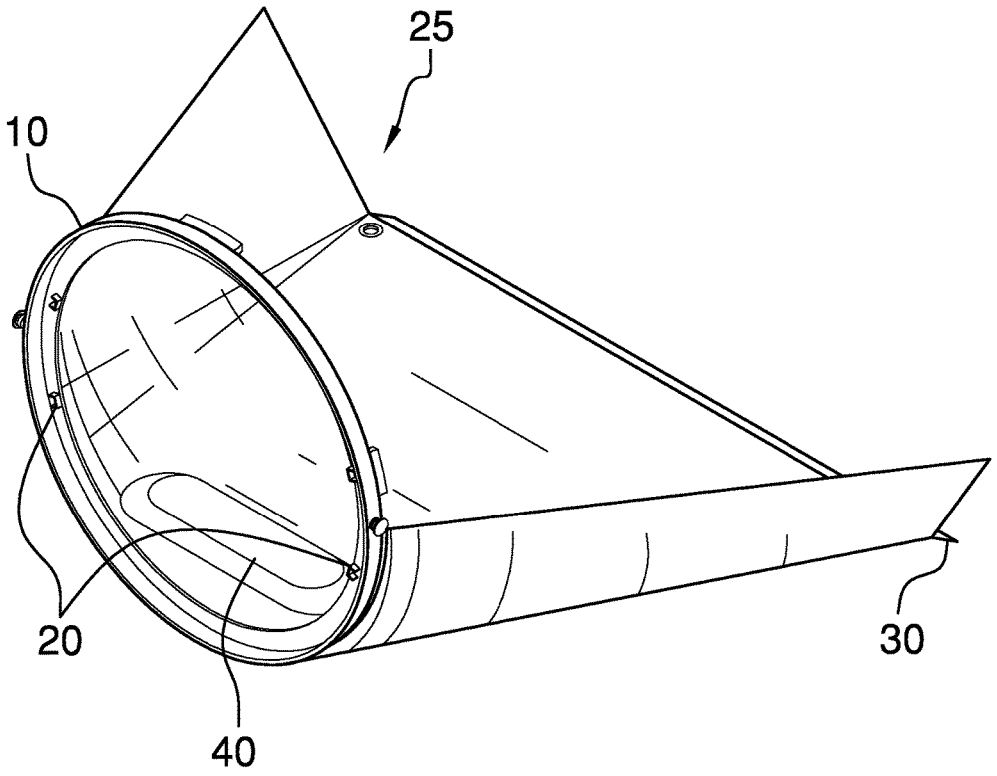
FIG. 2 is a back isometric view of the present invention.
Figure 3:
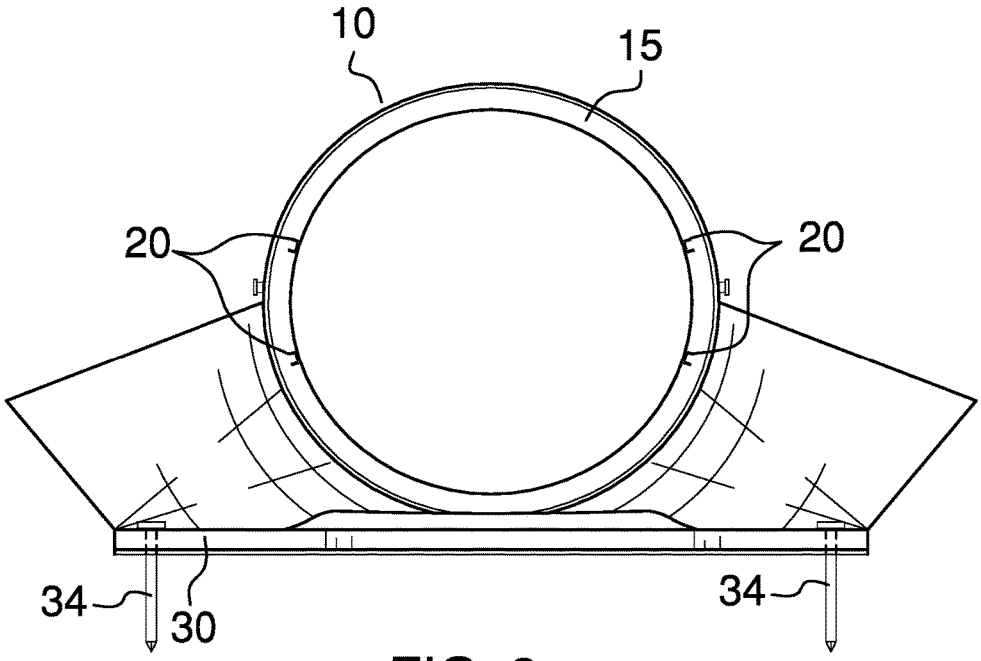
FIG. 3 is a front view of the present invention.

A plurality of clips 20 are positioned along the rim 10 as shown in FIG. 2. Each of the clips 20 is intended to hook or clip to the lip of a garbage can. It is understood that the lip of various garbage cans vary in size and shape. The clips 20 disclosed in the present invention is one example of a shape that may be provided. However, because there is not one universal garbage can lip, it is anticipated that a variety of differently shaped clips 20 may be provided. Depending on the shape of the lip, the clips 20 can be predetermined accordingly. It is also anticipated that the placement of the plurality of clips 20 can be adjustable. For example, the clips 20 may be attached to the rim 10 with a pin and hole assembly. Differently shaped clips 20 could be predetermined or that a set of various clips 20 could be provided, thereby allowing the user to affix the appropriate clips 20 for her or his garbage can. The plurality of clips may be attached to the rim or the flange.

A flange 15, which may be constructed from semi-rigid or rigid material and is attached to the rim and the bottom panel and side panels is provided adjacent to the rim 20 and slopes towards the inside of a garbage can as shown in FIG. 1. The flange 15 is shown to fit a garbage can with a circular opening. However, it is anticipated to fit a variety of garbage can openings much like the rim 10.

A scoop 25 is provided and it extends away from the garbage can as seen in FIG. 4, FIG. 5, and FIG. 6. The scoop 25 consists of a bottom panel 26 and two side panels 27. The bottom panel 26 provides a fold-down edge 30, which is angled toward the ground surface to help insure that all the leaves or debris being picked up are swept or positioned toward the garbage can. A raised portion or camber 40 is also provided on the bottom panel 26 to prevent the leaves and debris from spilling out of the scoop and onto the ground. Once a certain amount of leaves or other debris are swept or placed into the opening of a garbage can, the raised portion or camber 40 prevents leaves or other debris from falling back away from the garbage can when the can is lifted. The camber 40 is critical to efficiently collecting leaves or other debris into the garbage can and prevent yard waste and/or debris from falling away from the garbage can.

The present invention also provides a handle 35 to assist the user with lowering and lifting the garbage can that is attached to the present invention. In turn, the handle allows the user to place less strain on her or his back because she or he will not be required to bend over as much when tilting the full garbage can back to the upright position. While the handle 35 is depicted as being semi-circular and of a fixed shape, it is anticipated that the handle may be comprised of a rope or other flexible or semi-flexible material such as a plastic handle.

While the embodiments of the invention have been disclosed, certain modifications may be made by those skilled in the art to modify the invention without departing from the spirit of the invention.

The inventor claims:

1. An attachable debris collection apparatus that is comprised of:

a. a rim;
  wherein the rim is made of a semi-rigid or rigid material;
  wherein the rim is of a predetermined shape;
b. a flange;
  wherein the flange is made of a semi-rigid or rigid material;
  wherein the flange is of a predetermined shape;
  wherein the flange is adjacent to the rim;
  wherein the flange has a first side and a second side;
c. a plurality of clips;
  wherein the plurality of clips is made of a semi-rigid or rigid material;
  wherein the plurality of clips are of a predetermined shape;
d. a scoop;
  wherein the scoop is made of a semi-rigid or rigid material;
  wherein the scoop is of a predetermined shape;
  wherein the scoop has a first end and second end;
  wherein the first end of the scoop is adjacent to the rim and flange of a garbage can;
  wherein the scoop has a bottom surface and two side panels;
  wherein the side panels are positioned at an angle from the bottom panel;
  wherein a pair of holes are placed on the scoop;
e. a fold down edge;
  wherein the fold down edge is attached to the second end of the scoop;
  wherein the fold down edge is made of a semi-rigid material;
  wherein the fold down edge is of a predetermined size and shape;
f. a camber;
  wherein the camber is of a predetermined size;
  wherein the camber is of a semi-rigid material;
  wherein the camber is a raised portion toward the first end of the scoop;
  said camber is formed as part of the scoop;
  wherein the camber prevents the debris from exiting from the garbage can onto the bottom surface of the scoop;
g. a handle;
  wherein the handle is of a predetermined size;
h. a pair of stakes.

2. The device claimed in claim 1 wherein placement of the plurality of clips is adjustable.

3. The device claimed in claim 1 wherein the handle is made of a flexible material.

4. The device claimed in claim 1 wherein the camber is proximate to the first end of the scoop.

5. The device as described in claim 1 wherein the plurality of clips is attached to the rim.

6. The device as described in claim 1 wherein the plurality of clips is attached to the flange.

* * * * *